US010649393B2

(12) United States Patent
Iwamoto

(10) Patent No.: US 10,649,393 B2
(45) Date of Patent: May 12, 2020

(54) SHEET CONVEYING APPARATUS AND IMAGE FORMING APPARATUS

(71) Applicant: CANON KABUSHIKI KAISHA, Tokyo (JP)

(72) Inventor: Kazuyuki Iwamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/210,437

(22) Filed: Dec. 5, 2018

(65) Prior Publication Data

US 2019/0187607 A1 Jun. 20, 2019

(30) Foreign Application Priority Data

Dec. 14, 2017 (JP) ..... 2017-239952

(51) Int. Cl.
*G03G 21/16* (2006.01)
*G03G 15/16* (2006.01)
(Continued)

(52) U.S. Cl.
CPC ..... *G03G 21/1633* (2013.01); *E05D 3/02* (2013.01); *E05D 7/1044* (2013.01); *G03G 15/16* (2013.01);
(Continued)

(58) Field of Classification Search
CPC ..... G03G 21/1633; G03G 15/16; G03G 15/6508; G03G 21/1647; G03G 21/1619; G03G 15/6555; G03G 2215/00544; G03G 21/1638; G03G 15/6529; G03G 21/1623; G03G 15/6558; G03G 2215/0054; G03G 2221/1684; G03G 2221/169;
(Continued)

(56) References Cited

U.S. PATENT DOCUMENTS 9,268,287 B2 * 2/2016 Maruyama ..... G03G 15/6529
2002/0141800 A1 * 10/2002 Fuchi ..... B65H 3/44 399/388
(Continued)

FOREIGN PATENT DOCUMENTS

JP 2007-94186 A 4/2007
JP 2012-194496 A 10/2012
JP 2013-228641 A 11/2013

*Primary Examiner* — David M. Gray
*Assistant Examiner* — Laura Roth
(74) *Attorney, Agent, or Firm* — Canon U.S.A., Inc. IP Division

(57) ABSTRACT

A sheet conveying apparatus to convey a sheet to an image forming unit includes a main body, an opening/closing member, and first, second, and third portions. The opening/closing member can be opened and closed with respect to the main body, and the first, second, and third portions pivotably support the opening/closing member. The second support portion is provided below the first support portion and above the third support portion. Each of the first, second, and third portions include a projecting portion and a hole portion. A difference between a greatest length of the third projecting portion and a diameter of the third hole portion is larger than a difference between a greatest length of the first projecting portion and a diameter of the first hole portion and is larger than a difference between a greatest length of the second projecting portion and a diameter of the second hole portion.

14 Claims, 7 Drawing Sheets

(51) Int. Cl.

| | |
|---|---|
| ***E05D 7/10*** | (2006.01) |
| ***E05D 3/02*** | (2006.01) |
| ***G03G 15/00*** | (2006.01) |

(52) U.S. Cl.
CPC ..... *G03G 15/6508* (2013.01); *G03G 15/6555* (2013.01); *G03G 21/1619* (2013.01); *G03G 21/1638* (2013.01); *G03G 21/1647* (2013.01); *E05Y 2900/606* (2013.01); *G03G 2215/0054* (2013.01); *G03G 2215/00544* (2013.01); *G03G 2221/169* (2013.01)

(58) Field of Classification Search
CPC ... E05D 7/1044; E05D 3/02; E05Y 2900/606; B41J 29/13; B41J 29/026; H04N 1/00519; H04N 1/00525; H04N 1/00522; H04N 1/00538; H04N 1/00554
See application file for complete search history.

(56) References Cited

U.S. PATENT DOCUMENTS

| | | | | |
|---|---|---|---|---|
| 2004/0005166 | A1* | 1/2004 | Funakoshi | G03G 15/80 399/88 |
| 2004/0237690 | A1* | 12/2004 | Masuda | G03G 21/1633 74/469 |
| 2010/0329738 | A1* | 12/2010 | Shirai | G03G 15/231 399/124 |
| 2017/0115617 | A1* | 4/2017 | Yamaguchi | B65H 85/00 |
| 2017/0219990 | A1* | 8/2017 | Ishida | G03G 21/1633 |
| 2019/0003224 | A1* | 1/2019 | Reuter | E05D 7/0415 |
| 2019/0039392 | A1* | 2/2019 | Onishi | B41J 29/13 |

* cited by examiner

SHEET CONVEYING APPARATUS AND IMAGE FORMING APPARATUS

BACKGROUND OF THE INVENTION

Field of the Invention

The present disclosure relates to structures of a sheet conveying apparatus and an image forming apparatus, which include an opening/closing member including a sheet conveying unit.

Description of the Related Art

Hitherto, in a sheet conveying apparatus that conveys a sheet-shaped medium such as recording paper and an overhead projector (OHP) sheet and in an image forming apparatus that forms an image on a sheet, a configuration in which a conveyance path of a sheet is formed by combining conveyance guides, which guide the conveyed sheet, to perform stable sheet conveyance is used.

In such a configuration, when a jamming of a sheet occurs in the conveyance path while conveying the sheet, the conveyance guides need to be separated from each other to open the conveyance path so that the jammed sheet can be removed.

In Japanese Patent Application Laid-Open No. 2007-94186, a portion of a sheet conveyance path is provided in an opening/closing member that can be, with respect to an apparatus main body, opened and closed about a pivot shaft held by a rotation shaft holding member. Furthermore, disclosed therein is a configuration in which the sheet conveyance path is opened by opening the opening/closing member when removing a sheet that has been jammed in the sheet conveyance path.

Typically, in a configuration that opens the sheet conveyance path with an opening and closing operation of the opening/closing member, one conveyance guide is provided on an apparatus main body side, and another conveyance guide that pairs up with the one conveyance guide is provided on an opening/closing member side.

With such a configuration, since the conveyance path can be opened by separating the conveyance guides from each other with an opening operation of the opening/closing member, the sheet jammed inside the conveyance path can be removed readily.

However, as is the case of Japanese Patent Application Laid-Open No. 2007-94186, when the opening/closing member is attached to the apparatus main body in an openable and closable manner with hinges, when there is a large clearance in the fitted portions of each hinge portion, relative positional accuracy between the conveyance guide provided in the opening/closing member and the conveyance guide provided in the apparatus main body becomes poor. With the above, there are cases in which the sheet conveyed through the conveyance path formed with the conveyance guide provided in the opening/closing member and the conveyance guide provided in the apparatus main body become skewed. When such skewing of the sheet occurs, jamming of the sheet may occur in the conveyance path.

Accordingly, one may conceive of reducing the clearance of each hinge portion to improve the positional accuracy between the conveyance guides.

Furthermore, in such a configuration, in order to cover the portions of the apparatus main body other than the conveyance path, one may conceive of extending the opening/closing member in a direction of a pivotal axis of each hinge portion from the position where the hinge portion is provided to form a large opening/closing member. However, with such a configuration, when the clearance of the hinge portion is reduced as described above, there are cases in which an edge portion of the opening/closing member at a position distanced away from the hinge portion in the direction of the pivotal axis of the hinge portion becomes lifted with respect to the apparatus main body. With the above, the appearance quality of the apparatus may become degraded.

As a measure against the above, one may conceive of providing another hinge portion where the opening/closing member becomes lifted in order to suppress decrease in the appearance quality of the apparatus. However, when the opening/closing member is supported by the apparatus main body through three of more hinge portions, a deformation of the opening/closing member is facilitated when compared with a case in which the opening/closing member is supported by two hinge portions.

The above is because when the opening/closing member becomes inclined with respect to the apparatus main body, while the opening/closing member inclines along a straight line connecting two points of the hinge portions when two hinge portions are provided, when three or more hinge portions are provided, an inclination along a straight line connecting either two points becomes obstructed by the hinge portion provided at another point.

Accordingly, in a case in which three or more hinge portions are provided, stress is applied to each position where the hinge portion of the opening/closing member is provided, and due to that stress, the opening/closing member becomes deformed making the opening and closing operation difficult to perform.

SUMMARY OF THE INVENTION

Accordingly, in view of the above point, the present disclosure provides a sheet conveying apparatus and an image forming apparatus that are capable of suppressing the degradation of the appearance quality of the apparatus while suppressing the positional accuracy of the conveyance guide from becoming poor. In an example, a sheet conveying apparatus includes openable and closable guides, an opening/closing member supported by a first support portion, a second support portion, and a third support portion to be openable/closable with respect to an apparatus main body. Fitting clearances of the first support portion and the second support portion that are provided in the vicinity of the openable and closable guides are larger than a fitting clearance of the third support portion.

According to an aspect of the present disclosure, a sheet conveying apparatus, disposed below an image forming unit in a vertical direction and is configured to convey a sheet to the image forming unit from below the image firming unit in the vertical direction, includes an apparatus main body having a sheet storing unit configured to store a sheet, a conveying member configured to convey a sheet from the sheet storing unit to the image forming unit, a first conveyance guide provided in the apparatus main body, wherein the first conveyance guide is part of a conveyance path configured to guide, from a lower portion towards an upper portion of the apparatus main body, a sheet conveyed with the conveying member, an opening/closing member including a second conveyance guide, wherein the opening/closing member is capable of being opened and closed with respect to the apparatus main body, wherein, in a case in which the opening/closing member is in a closed state with respect to the apparatus main body, the second conveyance guide opposes the first conveyance guide and forms the conveyance path and, wherein, in a case in which the opening/closing member is in an open state with respect to the apparatus main body, the second conveyance guide is separated from the first conveyance guide and the conveyance path is open, a first support portion provided on an upper end side of the second conveyance guide of the opening/closing member in the vertical direction of the apparatus main body, wherein the first support portion pivotably supports the opening/closing member with respect to the apparatus main body, a second support portion provided on a lower end side of the second conveyance guide of the opening/closing member in the vertical direction, wherein the second support portion pivotably supports the opening/closing member with respect to the apparatus main body, and a third support portion provided below the first support portion and the second support portion in the vertical direction, wherein the third support portion pivotably supports the opening/closing member with respect to the apparatus main body, wherein the first support portion includes a first projecting portion, and a first hole portion configured to fit the first projecting portion to be relatively pivotable with respect to the first projecting portion, wherein the second support portion includes a second projecting portion, and a second hole portion configured to fit the second projecting portion to be relatively pivotable with respect to the second projecting portion, wherein the third support portion includes a third projecting portion, and a third hole portion configured to fit the third projecting portion to be relatively pivotable with respect to the third projecting portion, wherein a difference between a greatest length of the third projecting portion in a direction orthogonal to the vertical direction and on a straight line passing through a rotation center of the third support portion, and a diameter of the third hole portion is larger than a difference between a greatest length of the first projecting portion in the direction orthogonal to the vertical direction and on the straight line passing through a rotation center of the first support portion, and a diameter of the first hole portion, and wherein a difference between a greatest length of the third projecting portion in the direction orthogonal to the vertical direction and on a straight line passing through a rotation center of the third support portion, and a diameter of the third hole portion is larger than a difference between a greatest length of the second projecting portion in the direction orthogonal to the vertical direction and on the straight line passing through a rotation center of the second support portion, and a diameter of the second hole portion.

Further features of the present disclosure will become apparent from the following description of embodiments with reference to the attached drawings.

DESCRIPTION OF THE EMBODIMENTS

Figure 1:
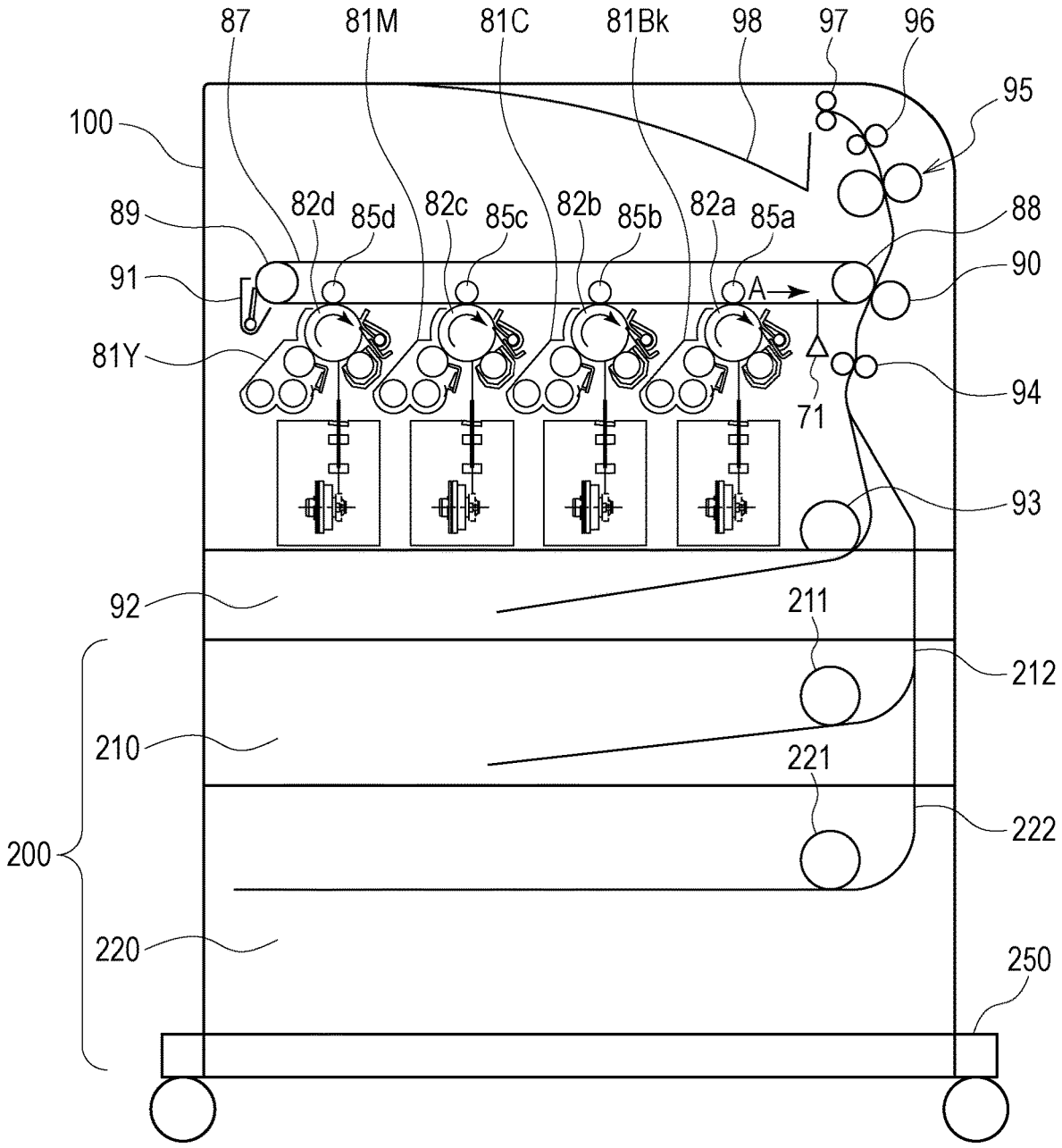
FIG. 1 is a cross-sectional view schematically illustrating an image forming apparatus.

Hereinafter, configurations embodying the present disclosure will be described with reference to the drawings. Note that the example embodiments described hereinafter do not limit the present disclosure according to the claims, and the combinations of the features described in the example embodiments are not necessarily essential in the solution of the present disclosure. Note that the members common in the drawings are denoted with the same reference numerals.

First Example Embodiment

Figure 2:
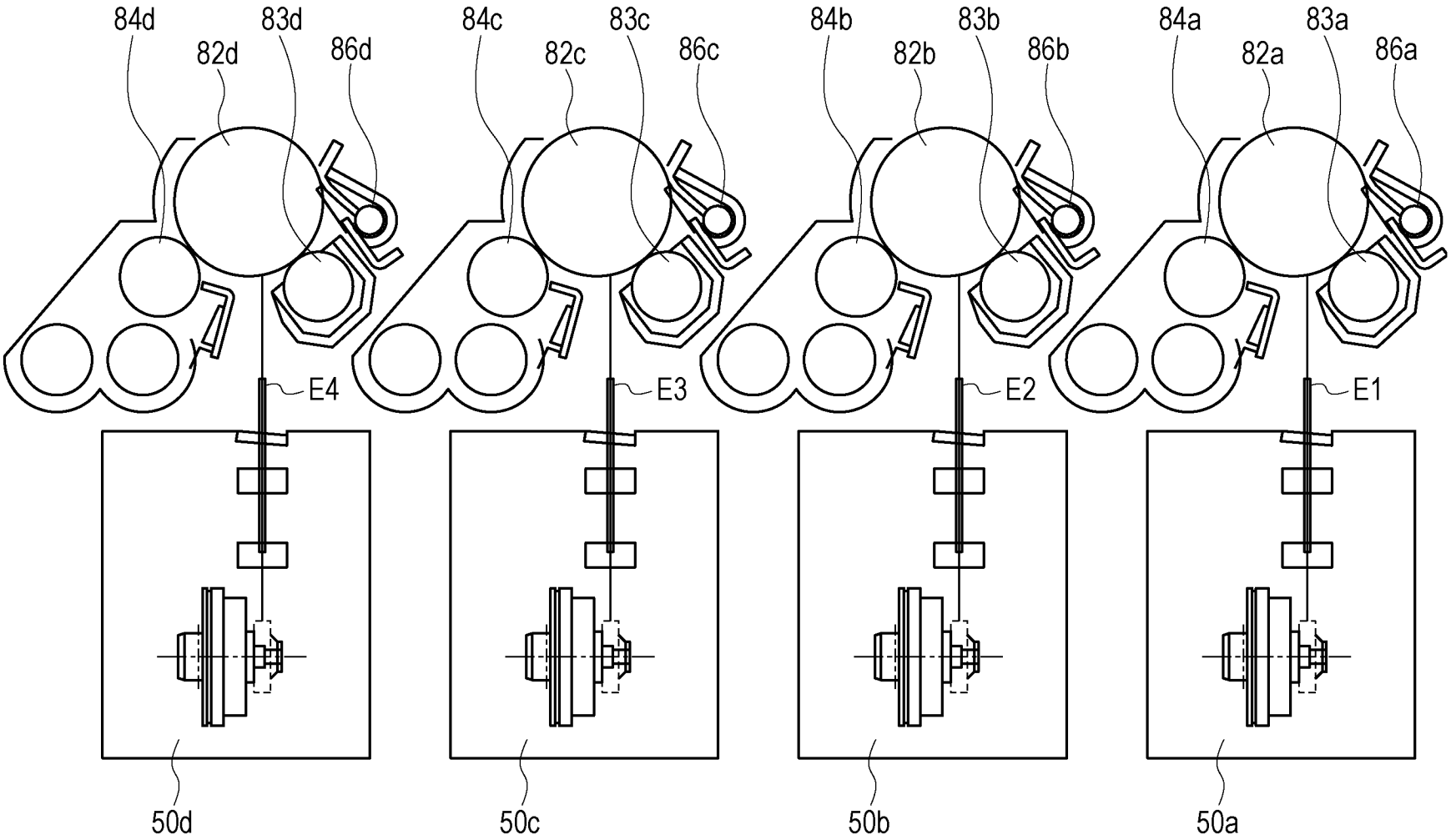
FIG. 2 is a cross-sectional view schematically illustrating image forming units.

FIG. 1 is a cross-sectional view schematically illustrating an image forming apparatus 100 of the present example embodiment. FIG. 2 is a cross-sectional view schematically illustrating vicinities of image forming units 81.

As illustrated in FIG. 1, the image forming apparatus 100 according to the present example embodiment is a color printer employing a tandem intermediate transfer system in which image forming units 81Y, 81M, 81C, and 81Bk arranged along a surface of an intermediate transfer belt 87 are disposed therein.

In the image forming unit 81Y, a yellow toner image is formed on a photosensitive drum 82*d* and is primarily transferred to the intermediate transfer belt 87 with a transfer roller 85*d*. In the image forming unit 81M, a magenta toner image is formed on a photosensitive drum 82*c* and is primarily transferred to the intermediate transfer belt 87 with a transfer roller 85*c*. In image forming units 81C and 81Bk, a cyan toner image and a black toner image are respectively formed on photosensitive drums 82*b* and 82*a* and are primarily transferred to the intermediate transfer belt 87 with the transfer rollers 85*b* and 85*a*, respectively. Specific configurations of the image forming units 81Y, 81M, 81C, and 81Bk will be described later with reference to FIG. 2.

An image forming process of each color is performed at a timing at which each toner image is overlapped on the toner image on the upstream side that has been primarily transferred on the intermediate transfer belt 87. As a result, toner images of four colors are formed on the intermediate transfer belt 87.

The intermediate transfer belt 87 is stretched across a pair of rollers, namely, a driving roller 88 and a belt conveyance roller 89, and is rotated and moved in an arrow A direction (the anticlockwise direction in FIG. 1). The intermediate transfer belt 87 is formed of dielectric resin such as, for example, a polycarbonate resin film, a polyethylene terephthalate resin film, polyvinylidine fluoride resin film.

The belt driving roller 88 abuts against a secondary transfer roller 90 with the intermediate transfer belt 87 interposed therebetween and forms a secondary transfer portion that transfers images on a sheet.

Furthermore, a belt cleaning device 91 that removes and collects transfer residual toner remaining on a surface of the intermediate transfer belt 87 is provided on an outer side of the intermediate transfer belt 87 and at the vicinity of the belt conveyance roller 89.

A registration detection sensor 71 is provided between the secondary transfer portion formed between the belt driving roller 88 and the secondary transfer roller 90 and a primarily transferring portion of the image forming unit 81Bk. The registration detection sensor 71 is provided so as to detect an amount of misalignment with respect to a reference color by detecting patterns of various colors for registration correction that are formed on the intermediate transfer belt 87 with the image forming units 81 of various colors.

Sheet-shaped recording mediums are stored in a main body sheet cassette 92 provided below the image forming units 81. The sheets stored in the main body sheet cassette 92 are separated sheet by sheet and are conveyed to a conveyance path with a separating and conveying roller 93, and are conveyed to a pair of registration rollers 94.

The pair of registration rollers 94 temporarily stop the conveyed sheet and convey the sheet to the secondary transfer portion at a timing at which the toner images formed on the intermediate transfer belt 87 are conveyed to the secondary transfer portion. With the above, toner is transferred onto the sheet.

Subsequently, the toner image on the sheet on which the toner image has been secondarily transferred is fixed to the sheet by being heated and pressed by a fixing unit 95, and the sheet is discharged onto a discharge tray 98 with a pair of conveyance rollers 96 and a pair of discharge rollers 97.

Furthermore, in the present example embodiment, an optional feeding deck unit 200 is provided under the image forming apparatus 100 and below the main body sheet cassette 92. The optional feeding deck unit 200 includes a first optional cassette 210 and a second optional cassette 220 that store sheets. In the present example embodiment, the second optional cassette 220 can store sheets that are larger than those stored in the first optional cassette 210. Note that the first optional cassette 210 and the second optional cassette 220 are each an example of a sheet storing unit.

The main body sheet cassette 92, the first optional cassette 210, and the second optional cassette 220 are each capable of storing sheets that have different sizes, and each feed sheets having an optional size that has been designated by the user.

Note that the sheets stored in the first optional cassette 210 are separated sheet by sheet and are conveyed to the pair of registration rollers 94 through a first conveyance path 212 with a first feed roller 211. Note that the sheets stored in the second optional cassette 220 are separated sheet by sheet and are conveyed to the pair of registration rollers 94 through a second conveyance path 222 with a second feed roller 221. Note that after the sheet fed from the second optional cassette 220 passes through the second conveyance path 222, the sheet is conveyed to the pair of registration rollers 94 through the first conveyance path 212 which is the same conveyance path through which the sheet fed from the first optional cassette 210 passes. Note that the first feed roller 211 and the second feed roller 221 are each an example of a conveying member.

Furthermore, a lower cover 250 is provided below the optional feeding deck unit 200 (vertically below an apparatus main body 200*a* described later). As illustrated in FIG. 1, tires and the like are provided below the lower cover 250 so that the apparatus main body is movably supported. The lower cover 250 is formed larger than the apparatus main body 200*a* of the optional feeding deck unit 200 in the front-rear direction and in the left-right direction. With the above, the optional feeding deck unit 200 and the image forming apparatus 100 disposed thereabove do not easily collapse. The lower cover 250 is an example of a lower cover unit.

Referring next to FIG. 2, a detailed configuration of the image forming unit 81 will be described.

The image forming units 81Bk, 81C, 81M, and 81Y are configured in substantially the same manner except for the colors of the toner, namely, black, cyan, magenta, and yellow, used in developing devices 84*a*, 84*b*, 84*c*, and 84*d*. Hereinafter, the image forming units 81Bk, 81C, 81M, and 81Y are described as the image forming unit 81 and redundant description of the image forming units 81Y, 81M, 81C, and 81Bk will be omitted.

A primary charge roller 83, an exposure device 50, a developing device 84, and a cleaning device 86 are disposed in the image forming unit 81 so as to surround the photosensitive drum 82. The photosensitive drum 82 is an OPC photosensitive member having a negative charge and includes a photoconductive layer on an aluminum drum base member. The photosensitive drum 82 is rotated at a predetermined process speed with a driving device (not shown). The primary charge roller 83 uniformly charges a surface of the photosensitive drum 82 with a charging bias applied from a charging bias power source (not shown) so that the surface has a predetermined electric potential having a negative polarity. The exposure device 50 forms an electrostatic image of the image on the surface of the photosensitive drum 82 by scanning a laser beam, which is a scanning line image signal on which an ON/OFF modulation has been performed based on the image data, with a rotary mirror. Each developing device 84 includes therein toner having the corresponding color. Each developing device 84 moves toner onto the corresponding photosensitive drum 82, and develops (forms into a visible image) the electrostatic latent image formed on the corresponding photosensitive drum 82 into a toner image that is a developer image.

Figure 3:
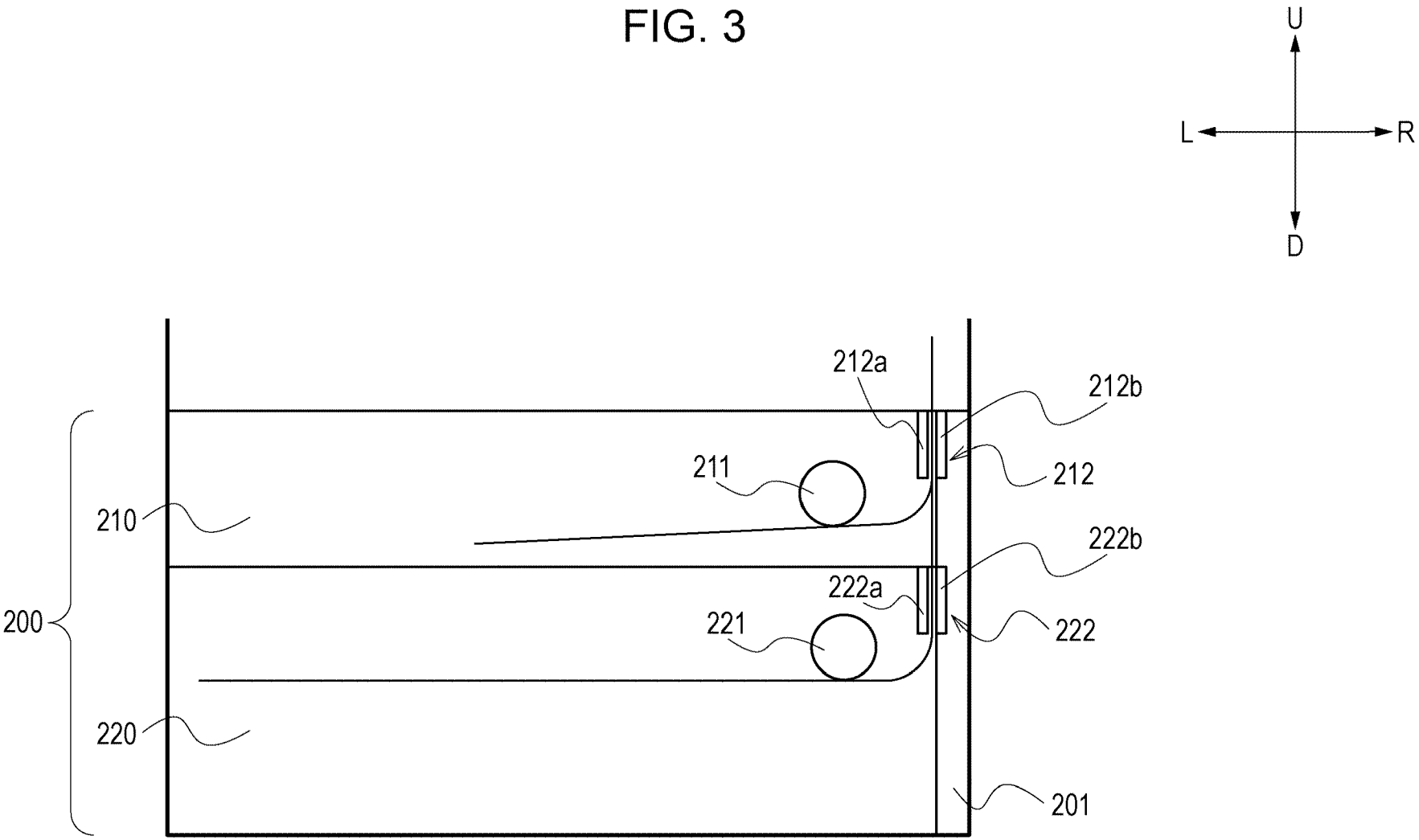
FIG. 3 is a schematic cross-sectional view of an optional feeding deck unit.
Figure 4:
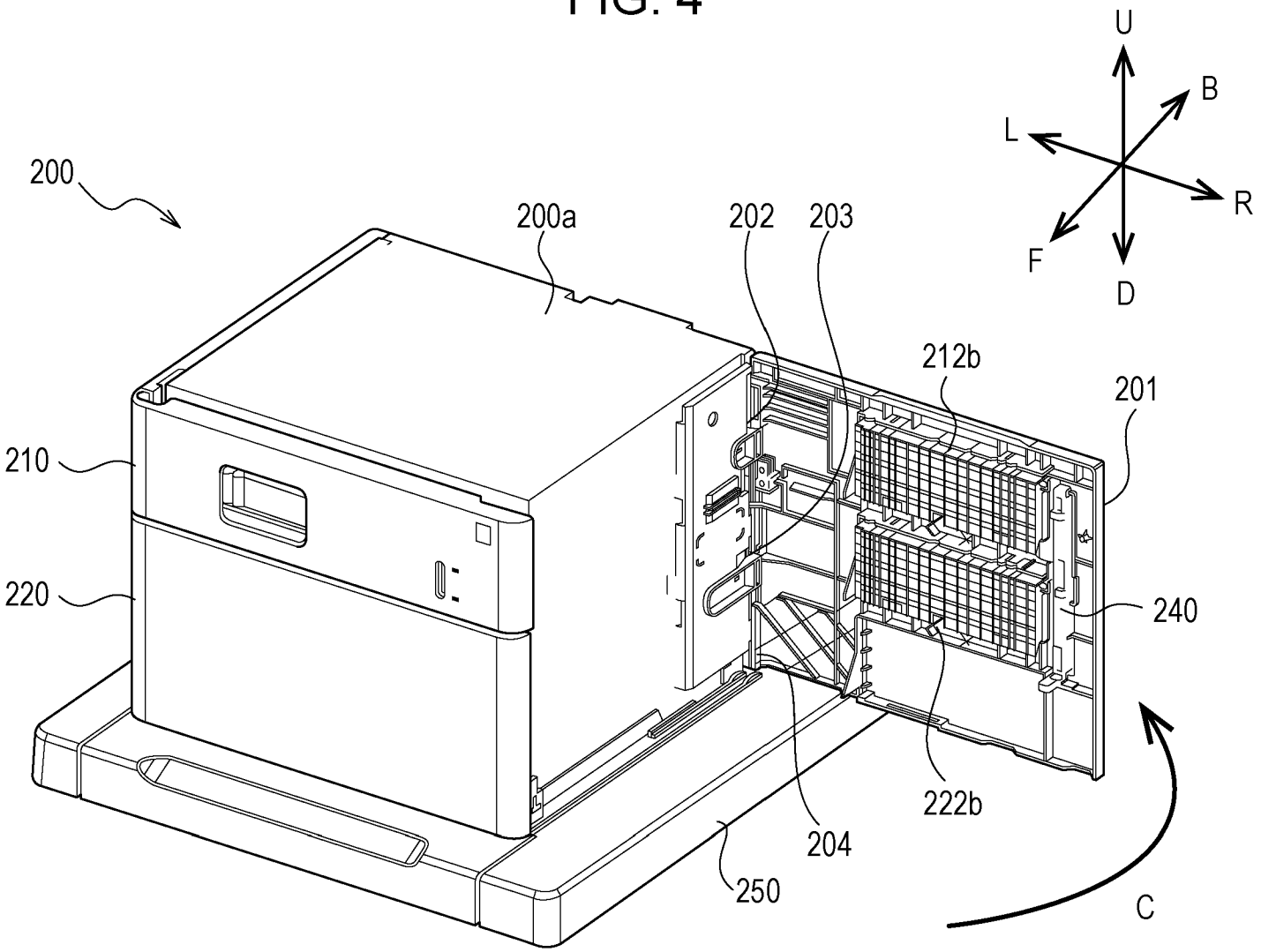
FIG. 4 is a schematic cross-sectional view of the optional feeding deck unit.

Referring next to FIGS. 3 and 4, a configuration of the optional feeding deck unit 200 according to the present example embodiment will be described. FIG. 3 is a schematic cross-sectional view of the optional feeding deck unit. FIG. 4 is a perspective view of the optional feeding deck unit 200 according to the present example embodiment. Note that an arrow F direction indicates the front side (the front face side) of the optional feeding deck unit 200, an arrow B direction indicates the back side (the rear face side), an arrow L direction indicates the left side, an arrow R direction indicates the right side, an arrow U direction indicates the upper side, and an arrow D direction indicates the lower side.

The optional feeding deck unit 200 includes an openable and closable door 201 that can be opened and closed with respect to the apparatus main body 200*a*. Note that the apparatus main body 200*a* is an example of a main body portion, and the openable and closable door 201 is an example of an opening/closing member.

The apparatus main body 200*a* pivotably supports the openable and closable door 201 with a first hinge portion 202, a second hinge portion 203, and a third hinge portion 204, and also serves as an outer cover on the right side of the optional feeding deck unit 200.

Furthermore, the openable and closable door 201 is openable and closable with respect to the apparatus main body 200*a* at a portion above the lower cover 250 in the vertical direction. Furthermore, the first hinge portion 202 is an example of a first support portion, the second hinge portion 203 is an example of a second support portion, and the third hinge portion 204 is an example of a third support portion.

As described above, the sheets stored in the first optional cassette 210 are fed and are conveyed to the first conveyance path 212 with the first feed roller 211. Note that the first conveyance path 212 is formed by opposing a first main body guide 212*a* provided on the apparatus main body 200*a* and a first openable and closable guide 212*b* provided on the openable and closable door 201 to each other.

Furthermore, the sheets stored in the second optional cassette 220 are fed and are conveyed to the second conveyance path 222 with the second feed roller 221. Note that the second conveyance path 222 is formed by opposing a second main body guide 222*a* provided on the apparatus main body 200*a* and a second openable and closable guide 222*b* provided on the openable and closable door 201 to each other.

The sheets fed from the first optional cassette 210 and the second optional cassette 220 are guided by the first conveyance path 212 and the second conveyance path 222 from a lower portion towards an upper portion of the apparatus main body 200*a* in the arrow U direction. The arrow U direction is an example of a sheet conveyance direction. Furthermore, the first main body guide 212*a* and the second main body guide 222*a* provided on the apparatus main body 200*a* are each an example of a first conveyance guide, and the first openable and closable guide 212*b* and the second openable and closable guide 222*b* are each an example of a second conveyance guide. Furthermore, the first openable and closable guide 212*b* is an example of an upper guide unit, and the second openable and closable guide 222*b* is an example of a lower guide unit.

Note that the sheet fed from the second optional cassette 220 is conveyed to the first conveyance path 212 through the second conveyance path 222. In other words, the sheet fed from the second optional cassette 220 is guided by the second main body guide 222*a* and the second openable and closable guide 222*b*, and the first main body guide 212*a* and the first openable and closable guide 212*b*, and is conveyed to the pair of registration rollers 94 of the image forming apparatus 100.

Furthermore, when a jamming of the sheet occurs in the first conveyance path 212 or the second conveyance path 222 in the optional feeding deck unit 200, by pivoting the openable and closable door 201 in an arrow C direction, the first openable and closable guide 212*b* and the second openable and closable guide 222*b* become separated from the first main body guide 212*a* and the second main body guide 222*a* of the apparatus main body 200*a*. With the above, the first conveyance path 212 and the second conveyance path 222 become open, and the sheet jammed in the conveyance path can be removed readily.

Furthermore, after removing the jammed sheet, by pivoting the openable and closable door 201 in a direction opposite to the arrow C direction, the first openable and closable guide 212*b* and the second openable and closable guide 222*b* approach and oppose the first main body guide 212*a* and the second main body guide 222*a* of the apparatus main body 200*a*. With the above, the first conveyance path 212 and the second conveyance path 222 are formed, and feeding of the sheets from the first optional cassette 210 and the second optional cassette 220 is allowed. In other words, the openable and closable door 201 is pivotable in a direction intersecting the sheet conveyance direction so as to allow the first openable and closable guide 212*b* and the second openable and closable guide 222*b* to approach and to become separated from the first main body guide 212*a* and the second main body guide 222*a* on the apparatus main body 200*a* side.

Furthermore, a lock member 240 is provided in the vicinity of the first openable and closable guide 212*b* and the second openable and closable guide 222*b* of the openable and closable door 201. The openable and closable door 201 can be locked to the apparatus main body 200*a* with the lock member 240.

Figure 5:
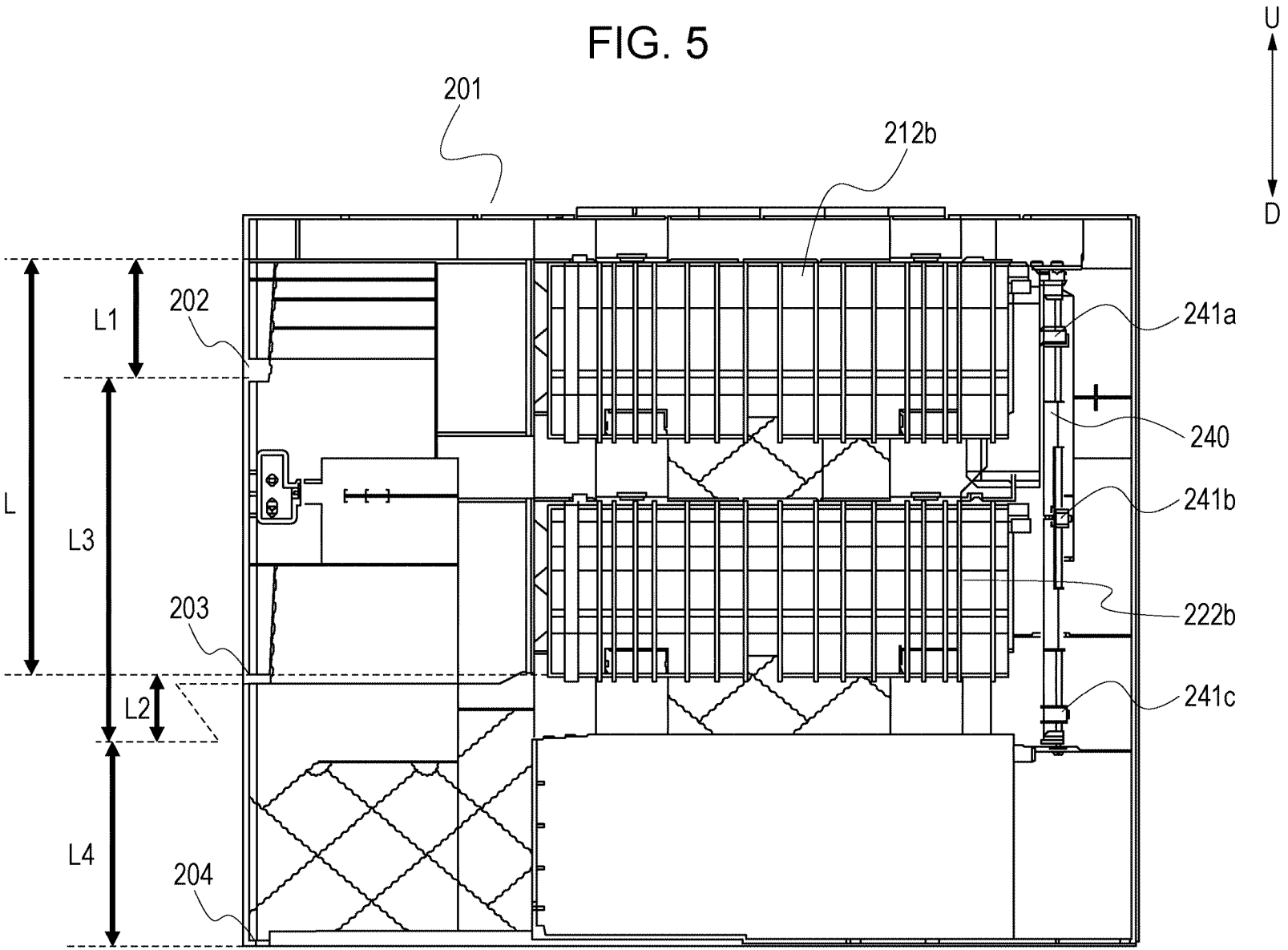
FIG. 5 is a plan view of an openable and closable door.

Referring next to FIG. 5, a configuration of the openable and closable door 201 will be described. FIG. 5 is a plan view of the apparatus main body 200*a* side of the openable and closable door 201. As described above, in the present example embodiment, the openable and closable door 201 is supported by the apparatus main body 200*a* in an openable and closable manner with three hinges, namely, the first hinge portion 202, the second hinge portion 203, and the third hinge portion 204. The three hinges are arranged in the vertical direction so that the pivotal axes thereof coincide with each other.

The lock member 240 includes a first projecting portion 241*a*, a second projecting portion 241*b*, and a third projecting portion 241*c* that engage with hole portions (not shown) provided in the apparatus main body 200*a*, and a locked state is reached by engaging each projecting portion 241 to the corresponding hole portion (not shown). With the above, a closed state of the openable and closable door 201 is maintained.

Furthermore, when the openable and closable door 201 is opened, the lock of the lock member 240 is released by an operator holding a grip portion (not shown) that releases the engagement between the first projecting portion 241*a*, the second projecting portion 241*b*, and the third projecting portion 241*c* and the corresponding hole portions. Note that in the openable and closable door 201, the lock member 240 is provided on a side opposite to the first hinge portion 202 and the second hinge portion 203 with respect to the first openable and closable guide 212*b* and the second openable and closable guide 222*b*. Furthermore, the first projecting portion 241*a*, the second projecting portion 241*b*, and the third projecting portion 241*c* are provided at positions that are closer to the first openable and closable guide 212*b* and the second openable and closable guide 222*b* than the first hinge portion 202 and the second hinge portion 203. Note that the lock member 240 is an example of a holding member.

Furthermore, the first hinge portion 202, the second hinge portion 203, and the third hinge portion 204 are configured so that the hole portions provided on the openable and closable door 201 side and the projecting portions provided on the apparatus main body 200*a* side are loosely fitted with each other and so that the hole portions and the projecting portions are relatively pivotable with respect to each other. With the above, the first hinge portion 202, the second hinge portion 203, and the third hinge portion 204 pivotably support the openable and closable door 201 with respect to the apparatus main body 200*a*. Detailed configurations of the hinge portions will be described later with reference to FIGS. 6A to 6F.

In the present example embodiment, the first hinge portion 202 is provided in the vicinity of the first openable and closable guide 212*b* with respect to a lower end of the openable and closable door 201 and on the downstream side in the sheet conveyance direction (the arrow U direction). In other words, the first hinge portion 202 is provided at substantially a top portion of the optional feeding deck unit 200. The second hinge portion 203 is provided in the vicinity of the second openable and closable guide 222*b* and on the upstream side of the second openable and closable guide 222*b* in the sheet conveyance direction (the arrow U direction). In other words, the second hinge portion 203 is provided at substantially a middle portion of the optional feeding deck unit 200. The third hinge portion 204 is provided in the vicinity of the lower end of the openable and closable door 201 and at a position distanced away from the first openable and closable guide 212*b* and the second openable and closable guide 222*b*. In other words, the third hinge portion 204 is provided in a lower portion of the optional feeding deck unit 200 that is a position other than between the first hinge portion 202 and the second hinge portion 203.

As illustrated in FIG. 5, when L is a length between an upper end of the first openable and closable guide 212*b* and a lower end of the second openable and closable guide 222*b*, L1 is a length between the upper end of the first openable and closable guide 212*b* and the first hinge portion 202, L2 is a length between the lower end of the second openable and closable guide 222*b* and the second hinge portion 203, L3 is a length between the first hinge portion 202 and the second hinge portion 203, and L4 is a length between the second hinge portion 203 and the third hinge portion 204, in the present example embodiment, the hinge portions are provided so as to satisfy the following relationships.

$$L1<\tfrac{1}{3}L$$

$$L2<\tfrac{1}{3}L$$

$$L3>\tfrac{2}{3}L$$

In the present example embodiment, L=193.6 mm, L1=55.8 mm, L2=3.7 mm, L3=141.5 mm, and L4=122.5 mm are satisfied. Note that a length between the upper end and the lower end of the openable and closable door 201 is 342.51 mm.

In other words, the first hinge portion 202 is provided in the vicinity of the upper end side (on an end portion side that is on the downstream side in the sheet conveyance direction) that is 55.8 mm from the upper end of the first openable and closable guide 212*b*. Furthermore, the second hinge portion 203 is provided in the vicinity of the lower end side (on an end portion side that is on the upstream side in the sheet conveyance direction) that is 3.7 mm from the lower end of the second openable and closable guide 222*b*.

With the above, the first openable and closable guide 212*b* and the second openable and closable guide 222*b* are disposed in the openable and closable door 201 at positions where separated distances from the apparatus main body 200*a* are small.

The above is because, in a case in which the openable and closable door 201 is supported by hinge mechanisms, lifting in a direction distancing away from the apparatus main body 200*a* does not easily occur at the positions in the openable and closable door 201 where the hinge mechanisms are provided compared with the positions where the hinge mechanisms are not provided.

With such a configuration, lifting of the first openable and closable guide 212*b* and the second openable and closable guide 222*b* with respect to the apparatus main body 200*a* is suppressed, and the positional accuracy of each guide can be refined. Accordingly, skewing of the sheet guided by the first openable and closable guide 212*b* and the second openable and closable guide 222*b* can be suppressed. Furthermore, a conveyance failure, which is jamming of a sheet in the conveyance path caused by skewing of the sheet, can be suppressed from occurring. Furthermore, skewing of a sheet, which is caused by a degradation in the positional accuracy between the main body guide and the openable and closable guide, to an extent that cannot be corrected with the pair of registration rollers 94 can be suppressed from occurring.

Furthermore, in the configuration described above, by satisfying L3≈L, the positional accuracies of the first openable and closable guide 212*b* and the second openable and closable guide 222*b* with respect to the first main body guide 212*a* and the second main body guide 222*a* of the apparatus main body 200*a* can be refined.

In the present example embodiment, the openable and closable door 201 is, with the configuration described above, supported by the apparatus main body 200*a* so that the spacing between the first main body guide 212*a* and the first openable and closable guide 212*b*, and the spacing between the second main body guide 222*a* and the second openable and closable guide 222*b* are each 1 to 2 mm.

Figure 6A:
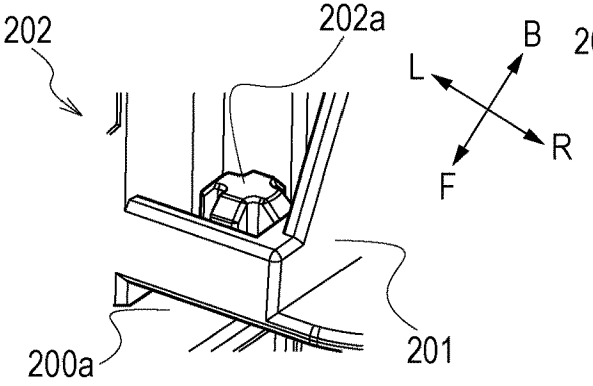
FIGS. 6A to 6F are diagrams illustrating a first hinge portion, a second hinge portion, and a third hinge portion.
Figure 6B:
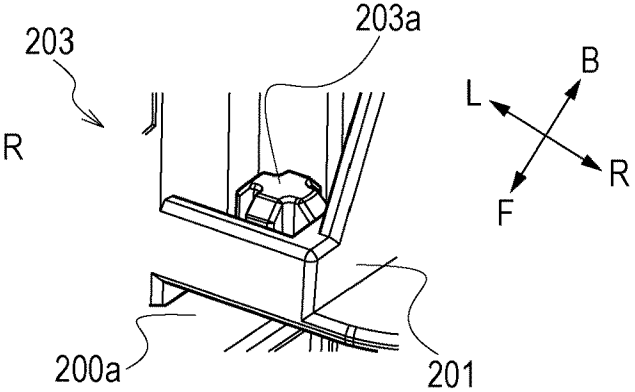
Figure 6C:
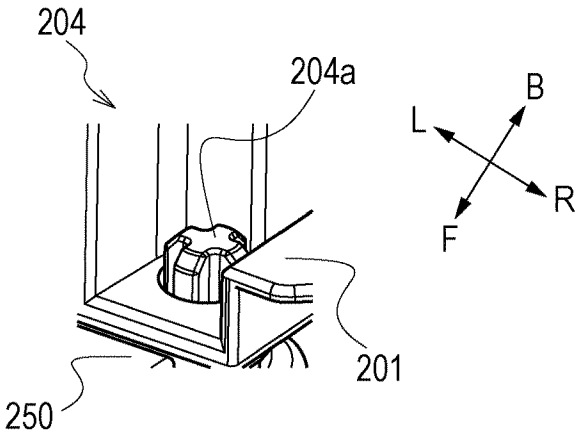
Figure 6D:
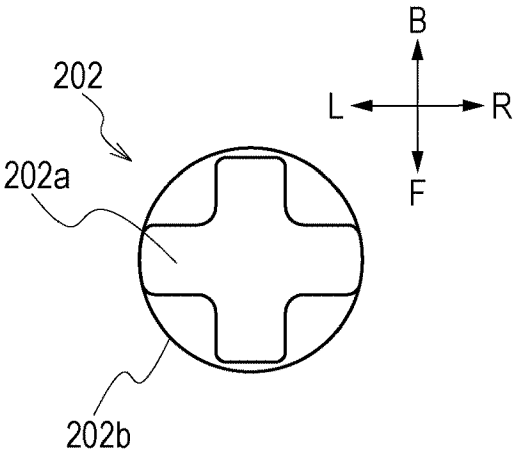
Figure 6E:
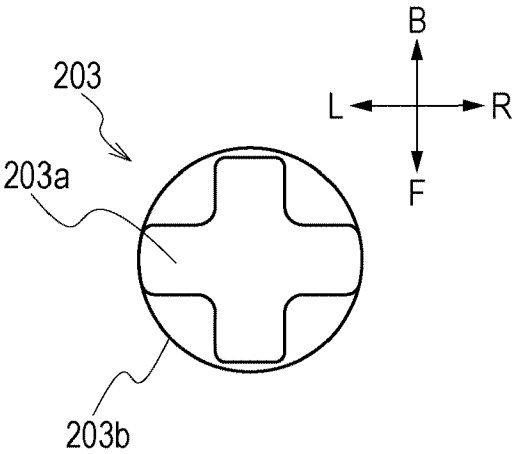
Figure 6F:
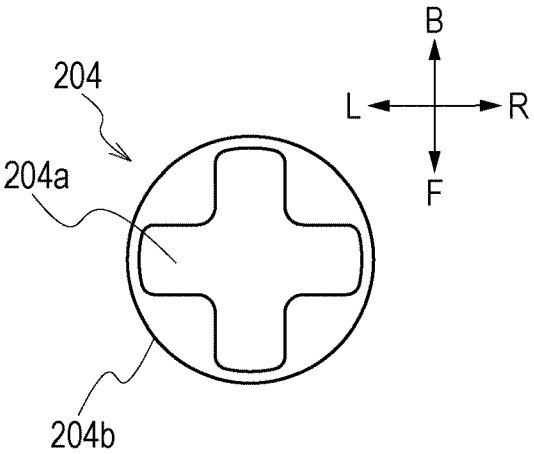

Subsequently, referring to FIGS. 6A to 6F, detailed configurations of the first hinge portion 202, the second hinge portion 203, and the third hinge portion 204 will be described. Note that FIG. 6A is a perspective view of the first hinge portion 202. FIG. 6B is a perspective view of the second hinge portion 203, FIG. 6C is a perspective view of the third hinge portion 204. FIG. 6D is a schematic top view of the first hinge portion 202. FIG. 6E is a schematic top view of the second hinge portion 203. FIG. 6F is a schematic top view of the third hinge portion 204.

As illustrated in FIGS. 6A and 6D, the first hinge portion 202 of the present example embodiment includes a first projecting portion 202*a* provided in the apparatus main body 200*a* and a first hole portion 202*b* provided in the openable and closable door 201. The first projecting portion 202*a* is loosely fitted to the first hole portion 202*b*, and the first hole portion 202*b* turns about the first projecting portion 202*a* with the opening and closing operation of the openable and closable door 201. Furthermore, the first hinge portion 202 is provided with a fitting clearance proportionate to the looseness of the fitting between the first projecting portion 202*a* and the first hole portion 202*b*. Note that the fitting clearance (looseness) is a difference between a surface of the first projecting portion 202*a* opposing a hole diameter of the first hole portion 202*b*, and a surface of a first hole portion 202*b* opposing the first projecting portion 202*a*. Furthermore, the fitting clearance is a difference between a length of the first projecting portion 202*a* in the left-right direction (an arrow LR direction) and a length of the first hole portion 202*b* in the left-right direction (the arrow LR direction). Furthermore, the fitting clearance is a difference between a greatest length of the first projecting portion 202*a* in a direction orthogonal to the vertical direction of the apparatus main body and on a straight line passing through a rotation center of the first hinge portion 202, and a diameter of the first hole portion 202*b*.

In the first hinge portion 202, an interval between the first projecting portion 202*a* and the first hole portion 202*b* in the left-right direction is smaller than an interval between the first projecting portion 202*a* and the first hole portion 202*b* in the in the front-rear direction. That is because while the first hole portion 202*b* is provided with a round shape, a left-right length of the first projecting portion 202*a*, which is provided so as to have a shape of a cross-shaped rib, is longer than a front-rear length thereof.

With the above, when the openable and closable door 201 is in a closed state, movement of the first projecting portion 202*a* in the left-right direction of the openable and closable door 201 is restricted by the first hole portion 202*b* and the movement of the openable and closable door 201 in a direction (in an arrow R direction) distancing away from the apparatus main body 200*a* is restricted. Accordingly, the positional accuracy between the first openable and closable guide 212*b* and the first main body guide 212*a* provided on the apparatus main body 200*a* side can be refined when the openable and closable door 201 is in the closed state. Note that the direction in which the openable and closable door 201 distances away from the apparatus main body 200*a* is the arrow R direction in the drawings, and the direction orthogonal to the distancing away direction is an F-B direction and is the front-rear direction of the apparatus main body 200*a*.

Furthermore, since lifting and looseness (clearance) of the openable and closable door 201 with respect to the apparatus main body 200*a* can be suppressed when the openable and closable door 201 is in the closed state, a degradation in appearance quality of the optional feeding deck unit 200 can be suppressed.

In the present example embodiment, the length of the first projecting portion 202*a* in the left-right direction is 6 mm, the length in the front-rear direction is 5.5 mm, and the size of the first hole portion 202*b* is φ6 mm. Note that the size of the first projecting portion 202*a* may be any within the tolerance range of −0.01 mm to −0.06 mm, and the size of the first hole portion 202*b* may be any within the tolerance range of +0.06 mm to 0.01 mm. As described above, by having the tolerance of the first projecting portion 202*a* take a negative value and the tolerance of the first hole portion 202*b* take a positive value, a situation in which the first projecting portion 202*a* and the first hole portion 202*b* cannot be loosely fitted to each other is averted.

As illustrated in FIGS. 6B and 6E, the second hinge portion 203 of the present example embodiment includes a second projecting portion 203*a* provided in the apparatus main body 200*a* and a second hole portion 203*b* provided in the openable and closable door 201. The second projecting portion 203*a* is loosely fitted to the second hole portion 203*b*, and the second hole portion 203*b* turns about the second projecting portion 203*a* with the opening and closing operation of the openable and closable door 201. Furthermore, the second hinge portion 203 is provided with a fitting clearance proportionate to the looseness of the fitting between the second projecting portion 203*a* and the second hole portion 203*b*. Note that the fitting clearance is a difference between a surface of the second projecting portion 203*a* opposing a hole diameter of the second hole portion 203*b*, and a surface of the second hole portion 203*b* opposing the second projecting portion 203*a*. Furthermore, the fitting clearance is a difference between a length of the second projecting portion 203*a* in the left-right direction (the arrow LR direction) and a length of the second hole portion 203*b* in the left-right direction (the arrow LR direction). Furthermore, the fitting clearance is a difference between a greatest length of the second projecting portion 203*a* in a direction orthogonal to the vertical direction of the apparatus main body and on a straight line passing through a rotation center of the second hinge portion 203, and a diameter of the second hole portion 203*b*.

Similar to the first hinge portion 202, in the second hinge portion 203, an interval between the second projecting portion 203*a* and the second hole portion 203*b* in the left-right direction is smaller than an interval between the second projecting portion 203*a* and the second hole portion 203*b* in the in the front-rear direction. That is because while the second hole portion 203*b* is provided with a round shape, a left-right length of the second projecting portion 203*a*, which is provided so as to have a shape of a cross-shaped rib, is longer than a front-rear length thereof.

With the above, when the openable and closable door 201 is in the closed state, since movement of the second projecting portion 203*a* in the left-right direction of the openable and closable door 201 is restricted by the second hole portion 203*b*, the movement of the openable and closable door 201 in a direction distancing away from the apparatus main body 200*a* is restricted. Accordingly, the positional accuracy between the second openable and closable guide 222*b* and the second main body guide 222*a* provided on the apparatus main body 200*a* side can be refined when the openable and closable door 201 is in the closed state.

Furthermore, since looseness (clearance) of the openable and closable door 201 with respect to the apparatus main body 200*a* can be suppressed when the openable and closable door 201 is in the closed state, a degradation in appearance quality of the optional feeding deck unit 200 can be suppressed.

Note that the second hinge portion 203 of the present example embodiment is configured with a size similar to that of the first hinge portion 202. Accordingly, in the present example embodiment, the length of the second projecting portion 203*a* in the left-right direction is 6 mm, the length in the front-rear direction is 5.5 mm, and the size of the second hole portion 203*b* is φ6 mm. Note that the size of the second projecting portion 203*a* may be any within the tolerance range of −0.01 mm to −0.06 mm, and the size of the second hole portion 203*b* may be any within the tolerance range of +0.06 mm to 0.01 mm. As described above, by having the tolerance of the second projecting portion 203*a* take a negative value and the tolerance of the second hole portion 203*b* take a positive value, a situation in which the second projecting portion 203*a* and the second hole portion 203*b* cannot be loosely fitted to each other is averted.

As illustrated in FIGS. 6C and 6F, the third hinge portion 204 of the present example embodiment includes a third projecting portion 204*a* provided in the lower cover 250 and a third hole portion 204*b* provided in the openable and closable door 201. The third projecting portion 204*a* is loosely fitted to the third hole portion 204*b*, and the third hole portion 204*b* turns about the third projecting portion 204*a* with the opening and closing operation of the openable and closable door 201. Furthermore, the third hinge portion 204 is provided with a fitting clearance proportionate to the looseness of the fitting between the third projecting portion 204*a* and the third hole portion 204*b*. Note that the fitting clearance is a difference between a surface of the third projecting portion 204*a* opposing a hole diameter of the third hole portion 204*b*, and a surface of the third hole portion 204*b* opposing the third projecting portion 204*a*. Furthermore, the fitting clearance is a difference between a length of the third projecting portion 204*a* in the left-right direction (the arrow LR direction) and a length of the third hole portion 204*b* in the left-right direction (the arrow LR direction). Furthermore, the fitting clearance is a difference between a greatest length of the third projecting portion 204*a* in a direction orthogonal to the vertical direction of the apparatus main body and on a straight line passing through a rotation center of the third hinge portion 204, and a diameter of the third hole portion 204*b*.

In the present example embodiment, the size of third projecting portion 204*a* is φ5.98 mm, and the size of third hole portion 204*b* is φ6.4 mm. Note that the size of the third projecting portion 204*a* may be any within the tolerance range of −0.01 mm to −0.06 mm, and the size of the third hole portion 204*b* may be any within the tolerance range of +0.06 mm to 0.01 mm. As described above, by having the tolerance of the third projecting portion 204*a* take a negative value and the tolerance of the third hole portion 204*b* take a positive value, a situation in which the third projecting portion 204*a* and the third hole portion 204*b* cannot be loosely fitted to each other is averted.

Note that the difference in the length of the third projecting portion 204*a* and the length of the third hole portion 204*b* of the third hinge portion 204 in the left-right direction is larger than the difference in the length of the first projecting portion 202*a* and the length of the hole of the first hole portion 202*b* of the first hinge portion 202 in the left-right direction. Furthermore, the difference in the length of the third projecting portion 204*a* and the length of the third hole portion 204*b* in the left-right direction of the third hinge portion 204 is larger than the difference in the length of the second projecting portion 203*a* and the length of the second hole portion 203*b* in the left-right direction of the second hinge portion 203.

In other words, the fitting clearance of the third hinge portion 204 is larger than the fitting clearances of the first hinge portion 202 and the second hinge portion 203. With the above, when supporting the operable and closable door 201 with the apparatus main body 200*a* and in a case in which the openable and closable door 201 is inclined along a straight line connecting two points, that is, the first hinge portion 202 and the second hinge portion 203, stress applied to the third hinge portion 204 becomes small.

Accordingly, when A1 is the hole diameter of the first hole portion 202*b*, B1 is a shaft diameter of the first projecting portion 202*a*, A2 is the hole diameter of the second hole portion 203*b*, B2 is a shaft diameter of the second projecting portion 203*a*, A3 is a hole diameter of the third hole portion 204*b*, and B3 is a shaft diameter of the third projecting portion 204*a*, the fitting clearances of the hinges are set to satisfy the following relationships.

$$A1-B1=A2-B2<A3-B3$$

$$A3-B3<(A1-B1+A2-B2)/L3*(L3+L4)$$

Note that if the fitting clearances of all three hinge portions are the same, the openable and closable door 201 will be supported while having the same stress be applied to three different points in a pivot axis direction. In such a case, a uniform stress is applied about the support points in the three hinge portions. Accordingly, in a case in which the openable and closable door 201 is supported in an inclined manner along a straight line connecting two hinges among the three hinge portions, a deflection or a distortion occurs in the openable and closable door 201 due to the stress applied to the other single hinge portion.

Accordingly, in the present example embodiment, by having a hinge portion among the three hinge portions have a large fitting clearance, even when the openable and closable door 201 becomes inclined about the two points having small fitting clearances, the inclination can be tolerated and stress due to the inclination is not easily applied to the hinge portions. With the above, even in a configuration in which three hinge portions are provided, a deflection or a distortion can be suppressed from occurring in the openable and closable door 201 caused by the stress generated between the support points of the hinge portions.

Furthermore, the third hinge portion 204 is provided at a position in the lower end of the openable and closable door 201 (the position where the third hinge portion 204 is provided) where the shift amount of the openable and closable door 201 with respect to the apparatus main body 200*a* becomes the largest when the openable and closable door 201 is supported only by the first hinge portion 202 and the second hinge portion 203. Furthermore, the fitting clearance of the third hinge portion is smaller than the largest shift amount at the lower end portion of the openable and closable door 201 when the openable and closable door 201 is supported only by the first hinge portion 202 and the second hinge portion 203. With the above, the lower end portion of the openable and closable door 201 becomes lifted with respect to the apparatus main body 200*a*, and a degradation in the appearance quality of the apparatus can be suppressed. Note that the fitting clearance of the third hinge portion 204 is configured so that stress is not easily applied to the hinge portions when, as described above, the openable and closable door 201 is inclined along the other two points.

Accordingly, in the present example embodiment, even with a configuration in which the positional accuracies of the first openable and closable guide 212*b* and the second openable and closable guide 222*b* with respect to the first main body guide 212*a* and the second main body guide 222*a* of the apparatus main body 200*a* are refined, owing to the configuration of the third hinge portion 204, the openable and closable door 201 can be suppressed from being lifted with respect to the apparatus main body 200*a* while a deformation of the openable and closable door 201 is prevented.

In order to refine the positional accuracies of the first openable and closable guide 212*b* and the second openable and closable guide 222*b* with respect to the apparatus main body 200*a*, if only the first hinge portion 202 and the second hinge portion 203 are provided at the positions described above, there are cases in which the edge portion of the openable and closable door 201 that is positioned at a distanced position with respect to the support points of the first hinge portion 202 and the second hinge portion 203 becomes lifted in a direction distancing away from the apparatus main body 200*a* when the openable and closable door 201 is brought to the closed state.

Conversely, in the present example embodiment, the third hinge portion 204 is provided in the openable and closable door 201 at a position that is distanced away from the first hinge portion 202 and the second hinge portion 203. Furthermore, the fitting clearance of the third hinge portion 204 is smaller than the largest lifted amount of the edge portion of the openable and closable door 201 supported by the first hinge portion 202 and the second hinge portion 203 having small fitting clearances. With the above, lifting with respect to the apparatus main body 200*a* can be suppressed at the position that is distanced away from the first hinge portion 202 and the second hinge portion 203 of the openable and closable door 201 (the lower end of the openable and closable door 201 in the present example embodiment). Accordingly, a degradation in the appearance quality of the apparatus due to the lifting of the openable and closable door 201 with respect to the apparatus main body 200*a* can be suppressed.

In the example embodiment described above, the third hinge portion 204 provided at a position that is farthest away from the first openable and closable guide 212*b* and the second openable and closable guide 222*b* is provided in the lower cover 250 that is a member different from the member in which the first hinge portion 202 and the second hinge portion 203 are provided. With the above, the engagement of the outer covers of the apparatus can be performed in a precise manner; accordingly, the appearance quality of the optional feeding deck unit 200 can be refined.

Furthermore, in the example embodiment described above, since the lock member 240 is provided in the vicinity of the first openable and closable guide 212*b* and the second openable and closable guide 222*b* in which the positional accuracies with respect to the apparatus main body 200*a* are refined, the positional accuracy of the lock member 240 with respect to the apparatus main body 200*a* can be refined as well. With the above, the operation of locking and unlocking of the openable and closable door 201 with the lock member 240 can be performed accurately.

In the example embodiment described above, in each hinge portion, the hole portion is provided on the openable and closable door 201 side, and the projecting portion that loosely fits with the hole portion is provided on the apparatus main body 200*a* side; however, the configuration may be any configuration that allows relative pivoting between the hole portion and the projecting portion. For example, each projecting portion may be provided on the openable and closable door 201 and the corresponding hole portion to which the projecting portion is loosely fitted can be provided on the apparatus main body 200*a* side.

Furthermore, regarding the third hinge portion 204, with the aim to suppress lifting of the openable and closable door 201 with respect to the apparatus main body 200*a*, the projecting portion 204*a* may be provided not in the lower cover 250 but in the apparatus main body 200*a*. Even such a configuration is capable of suppressing the edge portion of the openable and closable door 201 from becoming lifted with respect to the apparatus main body 200*a*.

Furthermore, rather than a configuration in which two conveyance guides, namely, the first openable and closable guide 212*b* and the second openable and closable guide 222*b*, are provided in the openable and closable door 201, a single conveyance guide may be provided. In a case in which such a configuration is adopted, when L is a length between an upper end and a lower end of the single conveyance guide, L1 is a length between the upper end of the conveyance guide and the first hinge portion 202, L2 is a length between the lower end of the conveyance guide and the second hinge portion 203, and L3 is a length between the first hinge portion 202 and the second hinge portion 203, by providing the hinge portions at positions that are the same as those of the configuration described above, the lifting of the opening cover can be prevented while refining the positional accuracy of the conveyance guide.

Furthermore, as long as the fitting clearance of the third hinge portion 204 is larger than the fitting clearances of the first hinge portion 202 and the second hinge portion 203, the difference in the length of the third projecting portion 204*a* and the length of the third hole portion 204*b* of the third hinge portion 204 in the front-rear direction may be larger than the difference in the length of the first projecting portion 202*a* and the length of the hole of the first hole portion 202*b* of the first hinge portion 202 in the front-rear direction. Furthermore, the difference in the length of the third projecting portion 204*a* and the length of the third hole portion 204*b* in the front-rear direction of the third hinge portion 204 is larger than the difference in the length of the second projecting portion 203*a* and the length of the second hole portion 203*b* in the front-rear direction of the second hinge portion 203. Even such a configuration is capable of suppressing lifting of the edge portion of the openable and closable door 201 with respect to the apparatus main body 200*a* with the third hinge portion 204.

Second Example Embodiment

Figure 7B:
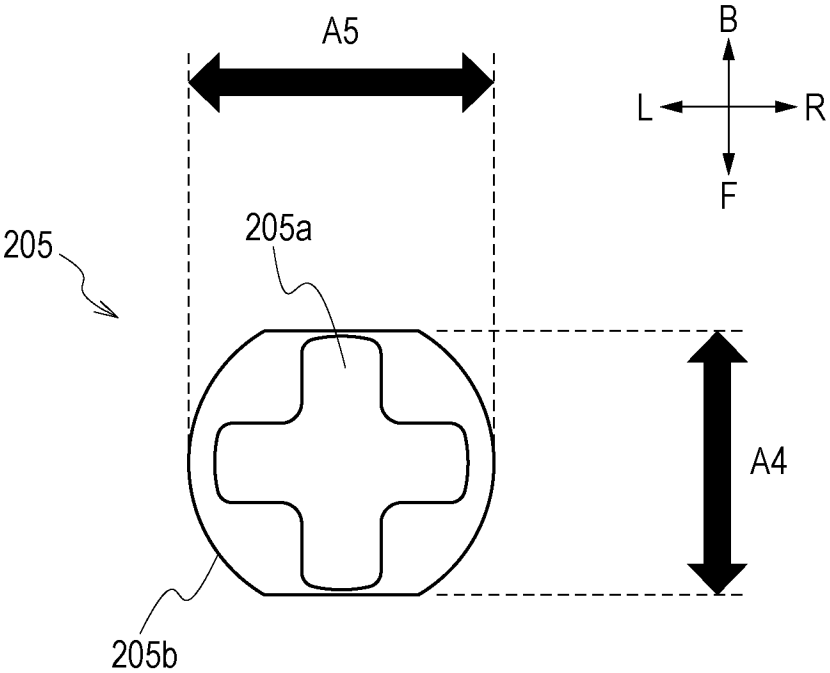
FIGS. 7A and 7B are schematic top views of a third hinge portion according to a second example embodiment.
Figure 7A:
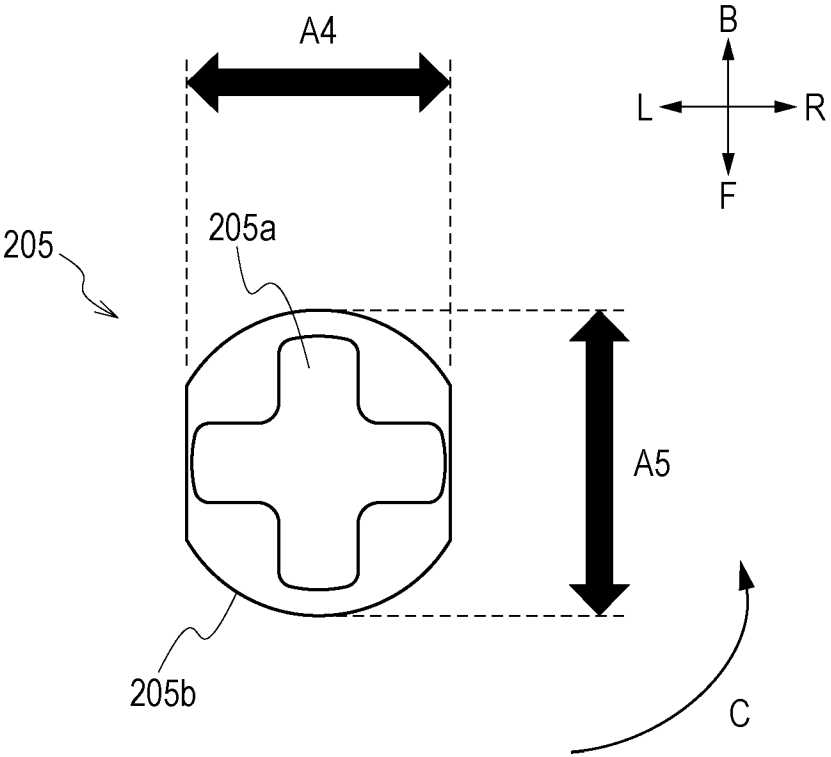

Referring next to FIGS. 7A and 7B, a description of a second example embodiment will be given. In the present example embodiment, a fourth hinge portion 205 having fitting clearances that are different in the radial directions of the hole portion is provided in place of the third hinge portion 204 according to the first example embodiment. Since the other configurations are the same as those of the first example embodiment, the same reference numerals are attached to the same configurations and description thereof will be omitted.

In FIG. 7A, the fourth hinge portion 205 when the openable and closable door 201 is in the closed state is illustrated. Furthermore, in FIG. 7B, the fourth hinge portion 205 when the openable and closable door 201 is in an open state is illustrated. The apparatus main body 200*a* pivotably supports the openable and closable door 201 with the fourth hinge portion 205 by having a fourth projecting portion 205*a* be loosely fitted to a fourth hole portion 205*b*. Note that when A4 is a length of the fourth hole portion 205*b* in the left-right direction (a width direction) of the apparatus main body 200*a*, A5 is a length of the fourth hole portion 205*b* in the front-rear direction, and B4 is a shaft diameter of the projecting portion 205*a*, the fourth hinge portion 205 is configured so that the following relationships are satisfied.

$$A1-B1=A2-B2<A4-B4<A5-B4$$

$$A4-B4<(A1-B1+A2-B2)/L3*(L3+L4)<A5-B4$$

As described above, the fitting clearances of the first hinge portion 202 and the second hinge portion 203 are the same and the fitting clearance of the fourth hinge portion 205 is larger than the fitting clearances of the first hinge portion 202 and the second hinge portion 203.

Furthermore, the fitting clearance of the fourth hinge portion 205 in the left-right direction is smaller than the shift amount at the vicinity of the lower end of the openable and closable door 201 with respect to the apparatus main body 200*a* when the openable and closable door 201 is supported by only the first hinge portion 202 and the second hinge portion 203. Accordingly, same as the first example embodiment, compared with a case in which the fourth hinge portion 205 is not provided, lifting of the lower end portion (the position distanced away from the first hinge portion 202 and the second hinge portion 203) of the openable and closable door 201 with respect to the apparatus main body 200*a* can be prevented when the openable and closable door 201 is in the closed state.

Furthermore, since the fitting clearance of the fourth hinge portion 205 in the front-rear direction is larger than the fitting clearances of the first hinge portion 202 and the second hinge portion 203, even when the openable and closable door 201 is inclined about a straight line that is linked to the two points having a small fitting clearance, the inclination is tolerated and stress is not readily applied to the support point with a large fitting clearance. With the above, even in a configuration in which three hinge portions are provided, a deflection or a distortion can be suppressed from occurring in the openable and closable door 201 caused by the stress generated between the support points of the hinge portions.

Furthermore, as illustrated in FIGS. 7A and 7B, the size of A4 is larger than the size of A5 in the fourth hole portion 205*b*. Accordingly, when the openable and closable door 201 is pivoted from the closed state illustrated in FIG. 7A to the open state illustrated in FIG. 7B, the fourth hole portion 205*b* rotates 90° in the arrow C direction.

Accordingly, compared with when the openable and closable door 201 is in the closed state, when in the open state, the fitting clearance of the fourth hinge portion 205 in the left-right direction of the apparatus main body 200*a* is larger. With such a configuration, while refining the appearance quality of the apparatus when the openable and closable door 201 is in the closed state, the pivoting when opening the openable and closable door 201 becomes smoother and operability can be refined.

As described above, the positional accuracies of the first openable and closable guide 212*b* and the second openable and closable guide 222*b* with respect to the first main body guide 212*a* and the second main body guide 222*a* of the apparatus main body 200*a* can be refined by providing three hinge portions, namely, the first hinge portion 202, the second hinge portion 203, and the fourth hinge portion 205, in the openable and closable door 201 and by setting the fitting clearances of the first hinge portion 202 and the second hinge portion 203 small. With the above, skewing of the sheet, the conveyance thereof being guided with the first conveyance path 212 and the second conveyance path 222, can be prevented.

Furthermore, by having the fitting clearance of the fourth hinge portion in the vicinity of the lower end of the openable and closable door 201 be larger than the fitting clearances of the first hinge portion 202 and the second hinge portion 203 that are closest to the first openable and closable guide 212*b* and the second openable and closable guide 222*b*, a deflection or a distortion can be suppressed from occurring in the openable and closable door 201 caused by the stress generated between the support points of the hinge portions.

With the above, the appearance quality of the apparatus can be refined.

Furthermore, by having the fourth hole portion of the fourth hinge portion 205 have a long hole shape, while preventing lifting of the lower end portion of the openable and closable door 201 with respect to the apparatus main body 200*a* when the openable and closable door 201 is in the closed state, the operability during the pivoting can be refined.

Other Example Embodiments

In the example embodiments described above, the first openable and closable guide 212*b* and the second openable and closable guide 222*b* are provided on the upper end portion side of the openable and closable door 201; however, the guides may be provided on the lower end portion side of the openable and closable door 201. Even with such a configuration, lifting of the openable and closable door 201 with respect to the apparatus main body 200*a* can be suppressed by providing a hinge portion such as the third hinge portion 204 on the end portion side of the openable and closable door 201, which is situated at a position distanced away in the sheet conveyance direction from the hinge portions provided in the vicinity of the conveyance guides. In other words, by providing the third hinge portion 204 at the upper end portion or the lower end portion of the openable and closable door 201, which is situated at a position other than between the first hinge portion 202 and the second hinge portion 203, lifting of the edge portion of the openable and closable door 201 with respect to the apparatus main body 200*a* can be suppressed.

Furthermore, in the example embodiments described above, two conveyance guides, namely, the first openable and closable guide 212*b* and the second openable and closable guide 222*b*, are provided in the openable and closable door 201; however, only a single conveyance guide may be provided or three of more conveyance guides may be provided. For example, two hinge portions may be provided at positions supporting the upstream side and the downstream side of the conveyance guide portions in the sheet conveyance direction, and a third hinge portion that has a fitting clearance that is larger than the fitting clearances of the other two hinge portions may be provided at a position that is upstream or downstream in the sheet conveyance direction and that is farthest away from the conveyance guide. In such a case as well, by adopting the configuration described above, lifting of the openable and closable door can be suppressed while the positional accuracies of the conveyance guide portions are refined.

Furthermore, in the example embodiments described above, while three hinge portions are provided, four or more may be provided. For example, in a case in which the conveyance guides are provided at the middle portion of the openable and closable door 201, hinge portions may be provided in the vicinities of the upper end portion and the lower end portion of the openable and closable door 201 that are at positions distanced away from the support points of the hinge portions provided in the vicinity of the conveyance guide. Even such a configuration is capable of suppressing the lifting of the openable and closable door 201 with respect to the apparatus main body 200*a*.

Furthermore, in the example embodiments described above, the openable and closable door 201 is provided in the optional feeding deck unit 200; however, the openable and closable door may be used as an openable and closable door of the image forming apparatus 100 including the conveyance guides. Furthermore, the example embodiments described above may be applied to other apparatuses that convey sheets, such as an image reading apparatus.

Furthermore, in the example embodiments described above, while the configuration in which the optional feeding deck unit 200 is attached to the image forming apparatus 100 as an option has been illustrated, the image forming apparatus 100 and the optional feeding deck unit 200 may be provided integrally.

The present disclosure is capable of suppressing decrease in the appearance quality of the apparatus caused by the opening/closing member being lifted with respect to the apparatus main body, while suppressing the deterioration in the relative positional accuracy between the conveyance guides provided in the apparatus main body and the conveyance guides provided in the opening/closing member.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-239952, filed Dec. 14, 2017 which is hereby incorporated by reference herein in its entirety.

What is claimed is:

1. A sheet conveying apparatus disposed below an image forming unit in a vertical direction and configured to convey a sheet to the image forming unit from below the image forming unit in the vertical direction, the sheet conveying apparatus comprising:

an apparatus main body including a sheet storing unit configured to store a sheet;

an opening/closing member configured to be openable and closable with respect to the apparatus main body;

a conveying member configured to convey a sheet from the sheet storing unit to the image forming unit;

a first conveyance guide provided in the apparatus main body, wherein the first conveyance guide is part of a conveyance path configured to guide, from a lower portion towards an upper portion of the apparatus main body;

a second conveyance guide provided on the opening/closing member and configured to form the conveyance path together with the first conveyance guide wherein the second conveyance guide opposes the first conveyance guide and forms the conveyance path in a case in which the opening/closing member is in a closed state with respect to the apparatus main body, and the second conveyance guide is separated from the first conveyance guide and the conveyance path is open in a case in which the opening/closing member is in an open state with respect to the apparatus main body;

a first support portion provided above the center of the opening/closing member in the vertical direction, wherein the first support portion includes a first projecting portion provided on either of the apparatus main body and the opening/closing member and a first hole portion in the other of the apparatus main body and the opening/closing member and that engages with the first projecting portion, and wherein the first supporting portion rotatably supports the opening/closing member with respect to the apparatus main body by the first projecting portion and the first hole portion relatively moving in a circumferential direction of the first hole portion;

a second support portion provided below the first support portion in the vertical direction, wherein the second support portion includes a second projecting portion provided on either one of the apparatus main body and the opening/closing member and a second hole portion provided in the other of the apparatus main body and the opening/closing member and that engages with the second projecting portion, and wherein the second supporting portion rotatably supports the opening/closing member with respect to the apparatus main body by the second projecting portion and the second hole portion relatively moving in a circumferential direction of the second hole portion and a third support portion provided below the second support portion in the vertical direction, wherein the third support portion includes a third projecting portion provided on either one of the apparatus main body and the opening/closing member and a third hole portion provided in the other of the apparatus main body and the opening/closing member and that engages with the third projecting portion, and wherein the third supporting portion rotatably supports the opening/closing member with respect to the apparatus main body by the third projecting portion and the third hole portion relatively moving in a circumferential direction of the third hole portion wherein a difference between a greatest length of the third projecting portion in a predetermined direction, orthogonal to both the vertical direction and a width direction of the sheet conveyed between the first conveyance guide and the second conveyance guide and a greatest length of the third hole portion in the predetermined direction, in a case where the opening/closing member is in the closed state, is larger than a difference between a greatest length of the first projecting portion in the predetermined direction and a greatest length of the first hole portion in the predetermined direction, in a case where the opening/closing member is in the closed state, and wherein a difference between a greatest length of the third projecting portion in the predetermined direction and on a straight line passing through a rotation center of the third support portion and a greatest length of the third hole portion in the predetermined direction in a case where the opening/closing member is in the closed state, is larger than a difference between a greatest length of the second projecting portion in the predetermined direction and on the straight line passing through a rotation center of the second support portion, in a case where the opening/closing member is in the closed state.

2. The sheet conveying apparatus according to claim 1, wherein the first support portion is provided at a position within ⅓L from the upper end of the second conveyance guide in the vertical direction, and the second support portion is provided at a position within ⅓L from the lower end of the second conveyance guide in the vertical direction, where L is a length between an upper end and a lower end of the second conveyance guide.

3. The sheet conveying apparatus according to claim 1, wherein the second conveyance guide includes an upper guide unit provided on an upper side in the vertical direction and a lower guide unit provided below the upper guide unit in the vertical direction, and wherein the following relationships hold true:

$$L1<\tfrac{1}{3}L,$$

$$L2<\tfrac{1}{3}L,$$

$$L3>\tfrac{2}{3}L,$$

where L is a length between an upper end portion of the upper guide unit and a lower end portion of the lower guide unit in the vertical direction, L1 is a length between the lower end portion of the lower guide unit and the first support portion in the vertical direction, L2 is a length between the upper end portion of the upper guide unit and the second support portion, and L3 is a length between the first support portion and the second support portion.

4. The sheet conveying apparatus according to claim 3, wherein the following relationships hold true:

$$A1-B1=A2-B2<A3-B3,$$

$$A3-B3<(A1-B1+A2-B2)/L3*(L3+L4)$$

where L4 is a length between the second support portion and the third support portion, A1 is a hole diameter of the first hole portion, B1 is a greatest length of the first projecting portion on the straight line passing through the rotation center of the first support portion, A2 is a hole diameter of the second hole portion, B2 is a greatest length of the second projecting portion on the straight line passing through the rotation center of the second support portion, A3 is a hole diameter of the third hole portion, and B3 is a greatest length of the third projecting portion on the straight line passing through the rotation center of the third support portion.

5. The sheet conveying apparatus according to claim 1, wherein the first projecting portion, the second projecting portion, and the third projecting portion are provided in the apparatus main body, and wherein the first hole portion, the second hole portion, and the third hole portion are provided in the opening/closing member.

6. The sheet conveying apparatus according to claim 1, wherein the third support portion is provided in a lower end portion of the opening/closing member in the vertical direction.

7. The sheet conveying apparatus according to claim 1,
wherein the apparatus main body includes a main body portion covered by (i) the opening/closing member when the opening/closing member is in the closed state and (ii) a lower cover unit provided below the opening/closing member in the vertical direction, and
wherein the first projecting portion and the second projecting portion are provided in the main body portion, and the third projecting portion is provided in the lower cover unit.

8. The sheet conveying apparatus according to claim 1, wherein, in the first support portion, the first projecting portion and the first hole portion are loosely fitted to each other so t an interval between the first hole portion and the first projecting portion in the width direction of the sheet conveyed between the first conveyance guide and the second conveyance guide is smaller than an interval between the first hole portion and the first projecting portion in the predetermined direction.

9. The sheet conveying apparatus according to claim 8,
wherein the first projecting portion is a cross-shaped rib and is provided in the apparatus main body, and
wherein a length of the first projecting portion in the left-right direction is longer than a length thereof in the predetermined direction.

10. The sheet conveying apparatus according to claim 8, wherein, in the second support portion, the second projecting portion and the second hole portion are loosely fitted to each other so that an interval between the second hole portion and the second projecting portion in the width direction of the sheet conveyed between the first conveyance guide and the second conveyance guide is smaller than an interval between the second hole portion and the second projecting portion in the predetermined direction.

11. The sheet conveying apparatus according to claim 10,
wherein the second projecting portion is a cross-shaped rib and is provided in the apparatus main body, and width
wherein a length of the second projecting portion in the width direction of the sheet conveyed between the first conveyance guide and the second conveyance guide is longer than a length thereof in the predetermined direction.

12. The sheet conveying apparatus according to claim 8, wherein, when the opening/closing member is in the closed state, the third hole portion is a hole portion having a long hole shape in which a size thereof in the width direction of the sheet conveyed between the first conveyance guide and the second conveyance guide is smaller than a size thereof in the predetermined direction.

13. The sheet conveying apparatus according to claim 1,
wherein the opening/closing member further includes a holding member configured to hold the opening/closing member in the closed state with respect to the apparatus main body, and
wherein, in the predetermined direction the holding member is provided on a side opposite to the first support portion and the second support portion with respect to the second conveyance guide.

14. An image forming apparatus comprising:
the sheet conveying apparatus according to claim 1; and
an image forming member configured to form an image on a sheet conveyed by the sheet conveying apparatus.

* * * * *